US006484404B1

(12) United States Patent
Kao

(10) Patent No.: US 6,484,404 B1
(45) Date of Patent: Nov. 26, 2002

(54) MULTI-FUNCTIONAL EXACTING KNIFE STRUCTURE

(76) Inventor: Liang-Shen Kao, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 09/977,692

(22) Filed: Oct. 16, 2001

(51) Int. Cl.[7] ..... B26B 3/06; B26B 29/00
(52) U.S. Cl. ..... 30/162; 30/2; 30/293
(58) Field of Search ..... 30/293, 294, 162, 30/335, 2

(56) References Cited

U.S. PATENT DOCUMENTS

| | | | | | |
|---|---|---|---|---|---|
| 1,586,646 | A | * | 6/1926 | Blevin et al. | 30/2 |
| 2,067,986 | A | * | 1/1937 | Schmidt | 30/2 |
| 2,537,287 | A | * | 1/1951 | Thomas | 30/294 |
| 2,797,477 | A | * | 7/1957 | Erdman | 30/2 |
| 4,001,936 | A | * | 1/1977 | Matsushita | 30/287 |
| 4,041,605 | A | * | 8/1977 | Selfridge | 30/293 |
| 4,043,038 | A | * | 8/1977 | Selfridge | 30/293 |
| 4,158,977 | A | * | 6/1979 | Logan | 30/293 |
| 4,866,847 | A | * | 9/1989 | Batrack et al. | 30/293 |
| 4,884,342 | A | * | 12/1989 | McNamara et al. | 30/162 |
| 5,203,086 | A | * | 4/1993 | Dann | 30/162 |
| 5,575,070 | A | * | 11/1996 | Anderson | 30/283 |
| 6,070,326 | A | * | 6/2000 | Berns | 30/2 |
| 6,178,640 | B1 | * | 1/2001 | Votolato | 30/2 |
| 6,195,896 | B1 | * | 3/2001 | Ireland | 30/2 |
| 6,324,763 | B1 | * | 12/2001 | Lee | 30/162 |
| 6,415,514 | B1 | * | 7/2002 | Chun | 30/162 |

FOREIGN PATENT DOCUMENTS

| | | | | |
|---|---|---|---|---|
| FR | 472055 | * | 7/1914 | 30/162 |

* cited by examiner

*Primary Examiner*—M. Rachuba
*Assistant Examiner*—Jason Prone
(74) *Attorney, Agent, or Firm*—Troxell Law Office PLLC

(57) ABSTRACT

The present invention relates to a multi-function exacter knife structure designed with a handle to correlate with the angle of the grip of the user as well as providing a slant panel for slanting the knife, and a wheel structure assisting in cutting and an adjustable structure allowing for adjusting cutting depth. The said structure provides multi function through a safer knife usage design, cutting depth adjustment and angle cutting capability, as well as the capability to cut straight lines without damaging rulers.

4 Claims, 5 Drawing Sheets

MULTI-FUNCTIONAL EXACTING KNIFE STRUCTURE

BACKGROUND OF THE INVENTION

1. Field of the Invention

The present invention relates to a multi-functional exacting knife structure, and specifically a handle design matching the grasping angle of the user, a slant board, a wheel structure and an adjustment structure. Through the said structures the design of the present invention provides a structure allowing adjustment of cutting depth and angle, resulting in a knife tool design with multi-function and safety designs.

2. Description of the Prior Art

I'm sure that you and I are both very familiar with exacting knifes which primarily provide a simple cutting function and therefore have blades differing in sharpness from most other knifes. There are different demands for the use of exacting knives based on the scope of different applications in different industries. For example, they are used for cutting a thin paneling in the refurbishing industry, but in other industries are used for cutting out letters or other shapes, etc. Thus we find that exacting knives play an important role in both living and work life.

The structure of traditional exacting knives consists of a handle with a blade holder, inside of which is a blade with an adjustable appliance at the end of the blade allowing the blade to either be extended or contracted thereby providing the user with an instrument of cutting everything.

However, surely everyone has had the experience of being cut because of improperly using an exacter knife. The reason for this is that exacter knife designs do not take in account cutting angles and usage methods.

Also, when using an exacter knife to cut in a straight line a ruler must be used for guidance and if the ruler is made of wood or plastic then its edge will often be cut and damaged by the knife. On the other hand if the ruler is made of metal it will damage sharpness of the knife blade. Also, exacter knives also have no way of controlling cutting depth and it is therefore inconvenient to always have to place a board underneath whatever is being cut.

In addition to this exacter knives have no way of regulating the cutting angle and when needing to make curved cuts (for example artists or refinishers) the user often has to switch to using a tool with special specifications in order to complete the job.

Due to the above described reasons the present inventor has developed a new multi-functional exacter knife structure with the hope of solving well known deficiencies while providing a more safe and convenient to use exacter knife.

SUMMARY OF THE INVENTION

The primary objective of the present invention is to provide a handle design that corresponds to the gripping angle of the user, thereby allowing the user to save energy while cutting while increasing usage safety.

Another objective of the present invention is to provide a structure allowing the adjusting the blade cutting depth, thereby maintaining the blade and allowing the blade to not be affected by excessive pressure and influencing blade life because of cutting too deep, as well as being concerned for safety by reducing dangerous breakage because of excessive pressure during cutting.

Yet a further objective for the design of the present invention is to provide the ability to cut at angles thereby increasing knife function and solving the problem and inconvenience of having to use a special ruler when cutting at an angle.

For a detailed explanation and technical content of the present invention see the following explanation in combination with the attached FIGS.:

BRIEF DESCRIPTION OF THE DRAWINGS

FIG. 5—1 is a side view of the present invention illustrating cutting movement.

FIG. 5—2 is a cross-sectional movement view of the present invention illustrating adjustment movement.

DETAILED DESCRIPTION OF THE PREFERRED EMBODIMENTS

Figure 1:
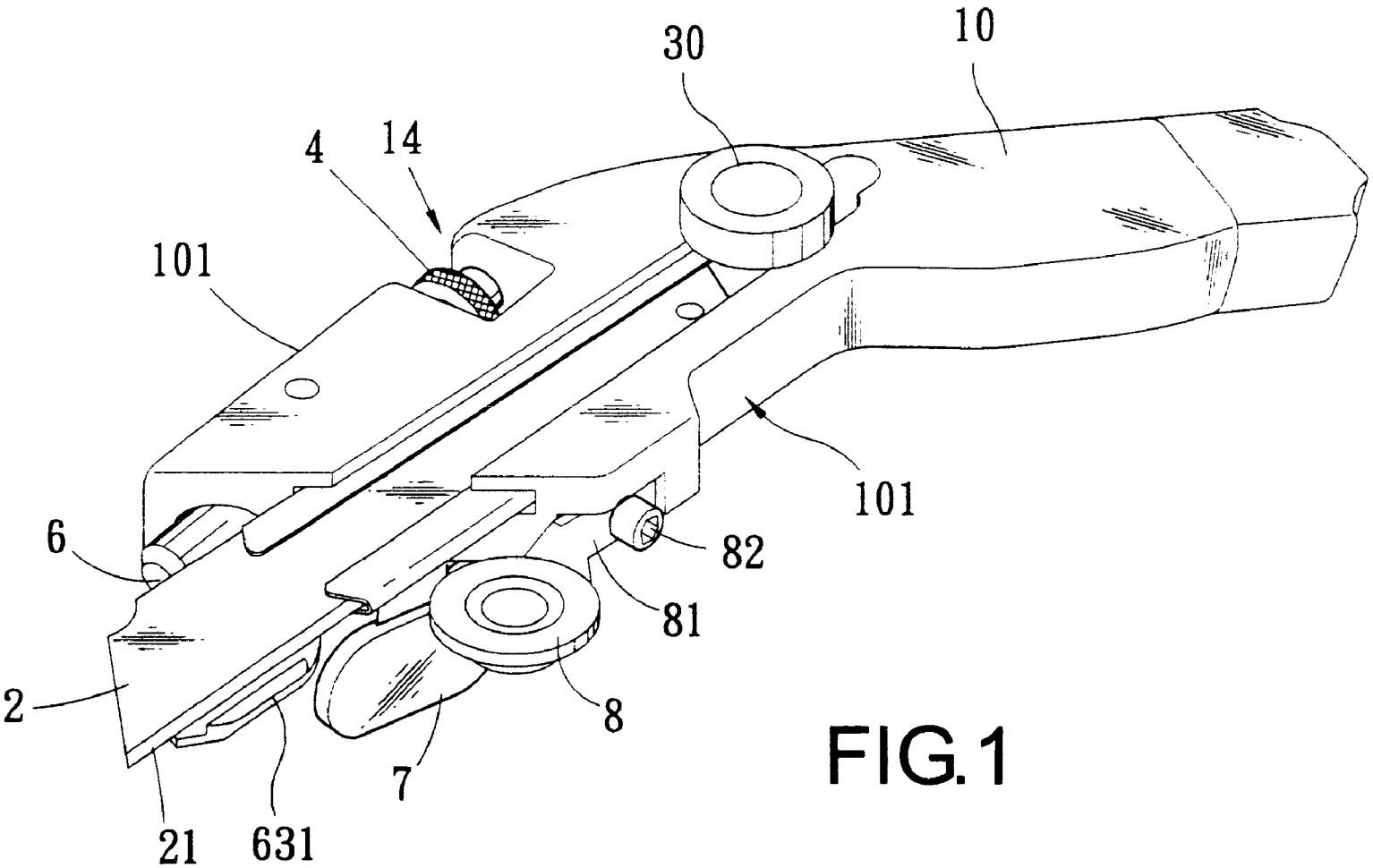
FIG. 1 is a perspective view of the present invention.
Figure 2:
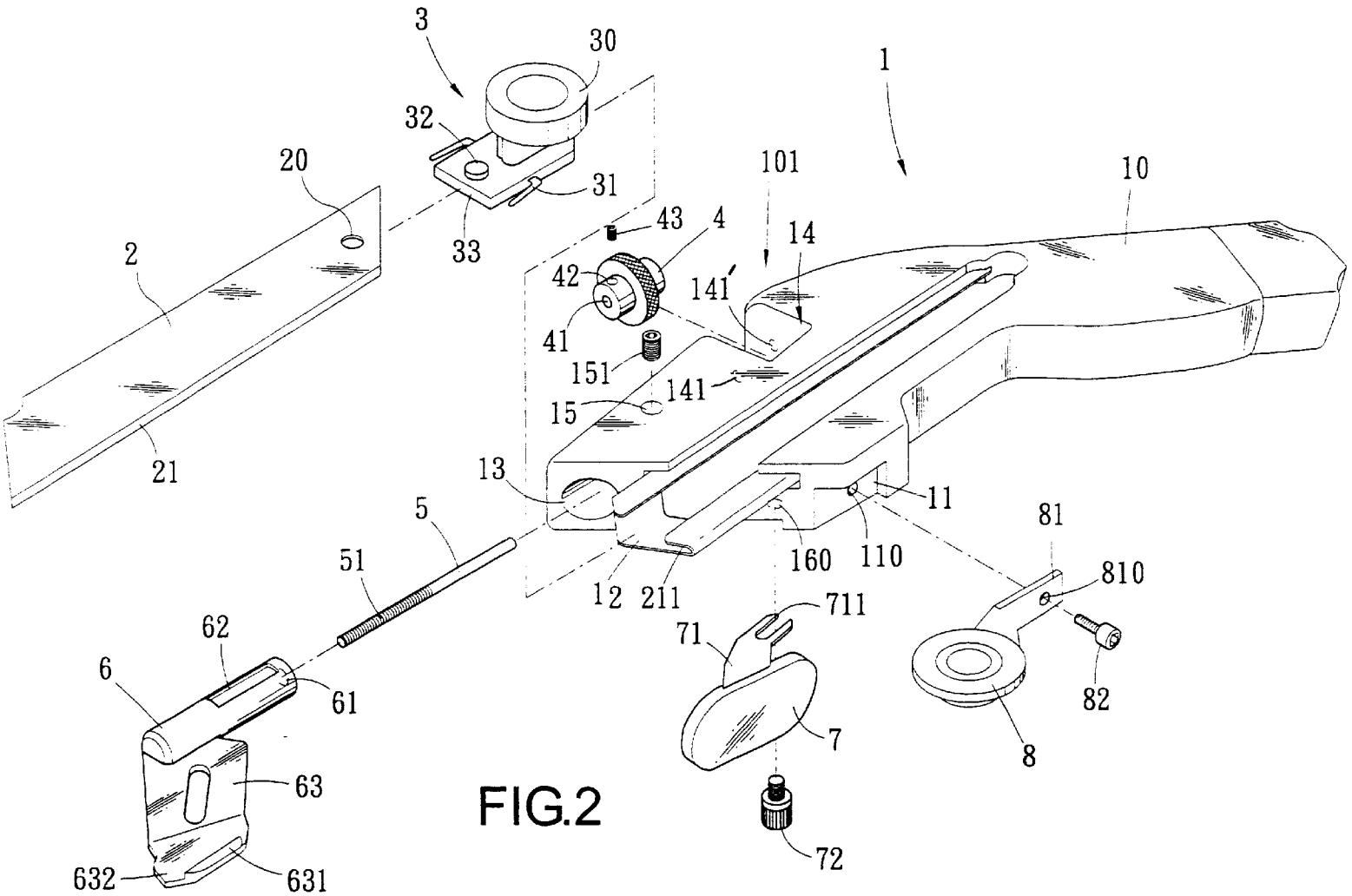
FIG. 2 is a perspective exploded view of the present invention.
Figure 3:
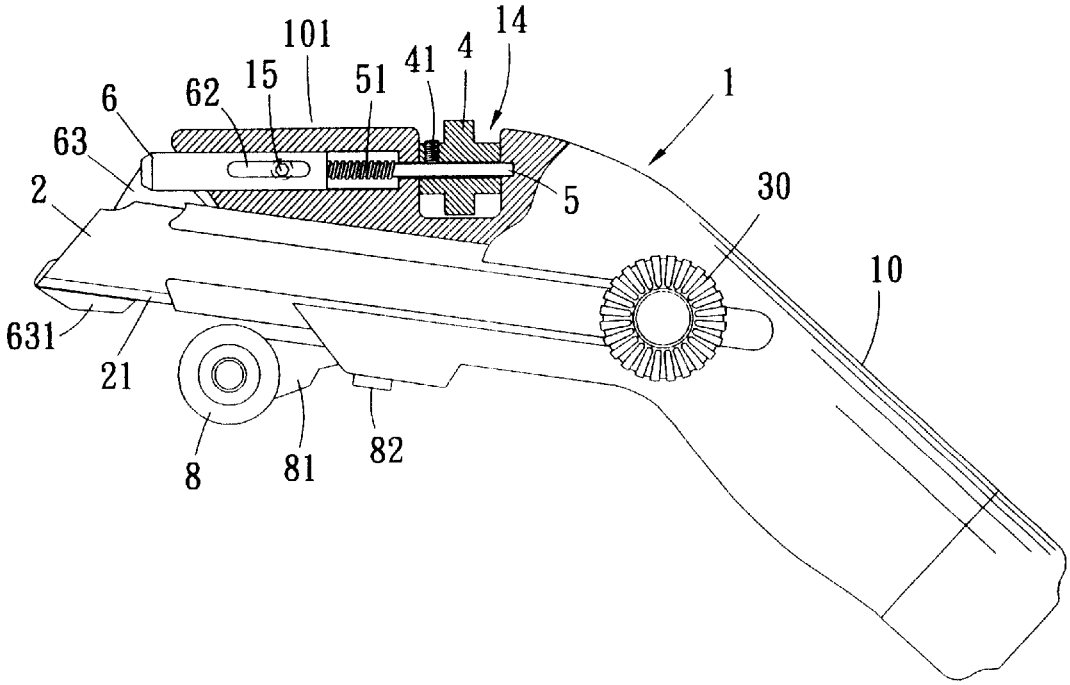
FIG. 3 is a cross-sectional structural view of the present invention.

First simultaneously look at FIG. 1 through FIG. 3 showing the present invention providing an exacter knife 1 comprised of a knife part 101 and a handle part 10. The handle part 10 makes it easier for the user to grasp the knife tool during cutting and extends the distance of cutting edge 21 from the pressure point for increased user safety. Also, the angled design between the knife 101 and the handle 10 enable the user to conserve effort while cutting.

Inside of knife part 101 is a trough case 12 inside of which holds blade 2 from which cutting edge 21 is formed. Blade 2 consists of stamped metallic plating that breaks when bent. Blade 2 and trough case 12 together form a blade trough 211. At the end of blade 2 is a hole 20 through which a button 32 that is part of a holding structure 3 that holds blade 2 in place. Holding structure 3 includes a base 33 on top of which is formed a holding bolt 30 that controls the position of blade 2. Holding strips 31, 31' are located on both sides of base 33. When blade 2 is encased in blade trough 211 holding strips 31, 31' can hold the two together so that blade 2 slides out of blade trough 211 when holding bolt 30 is loosened.

On the top of knife tool part 101 is a trough 14 in which an adjusting wheel 4 is contained and in the center of both walls of trough 14 are located notches 141 and 141'. Of these notches notch 141 connects to a tube trough 13 at the front through which a shaft 5 passes and the end of shaft 5 passes through notch 141 and a bore hole 41 going through adjusting wheel 4 to fit into the notch 141'. On one side of adjusting wheel 4 is located a lock hole 42 that holds fixing bolt 43 which locks shaft 5 in connection with adjusting wheel 4.

The other end of shaft 5 forms a screw part 51 of an appropriate length connecting to a lock hole 61 on an adjusting bolt 6. At the front of adjusting bolt 6 is a stabilizing piece 63, which stabilizing piece 63 on the top shapes into guiding support 632 providing blade 2 with guidance and increased control when applying pressure and on the end of guiding support 632 is prop 631 that can adjust the contact depth between cutting edge 21 and the object being cut.

On the side of adjusting bolt 6 is a horizontal groove 62 that lines up with a lock hole on the side of knife part 101 through which fixing bolt 151 screws through lock hole 15 and keeps adjusting bolt 6 within the limit of horizontal groove 62.

Also, there is an indentation 11 on the bottom of knife part 101 into which a base 81 for a wheel 8 fits and in indentation 11 is a screw hole 110 that lines up with a hole 810 through base 81 and into which a screw 82 locks, thereby providing the present invention with a support structure that allows the present invention to cut straight lines without the need for a ruler.

Figure 4:
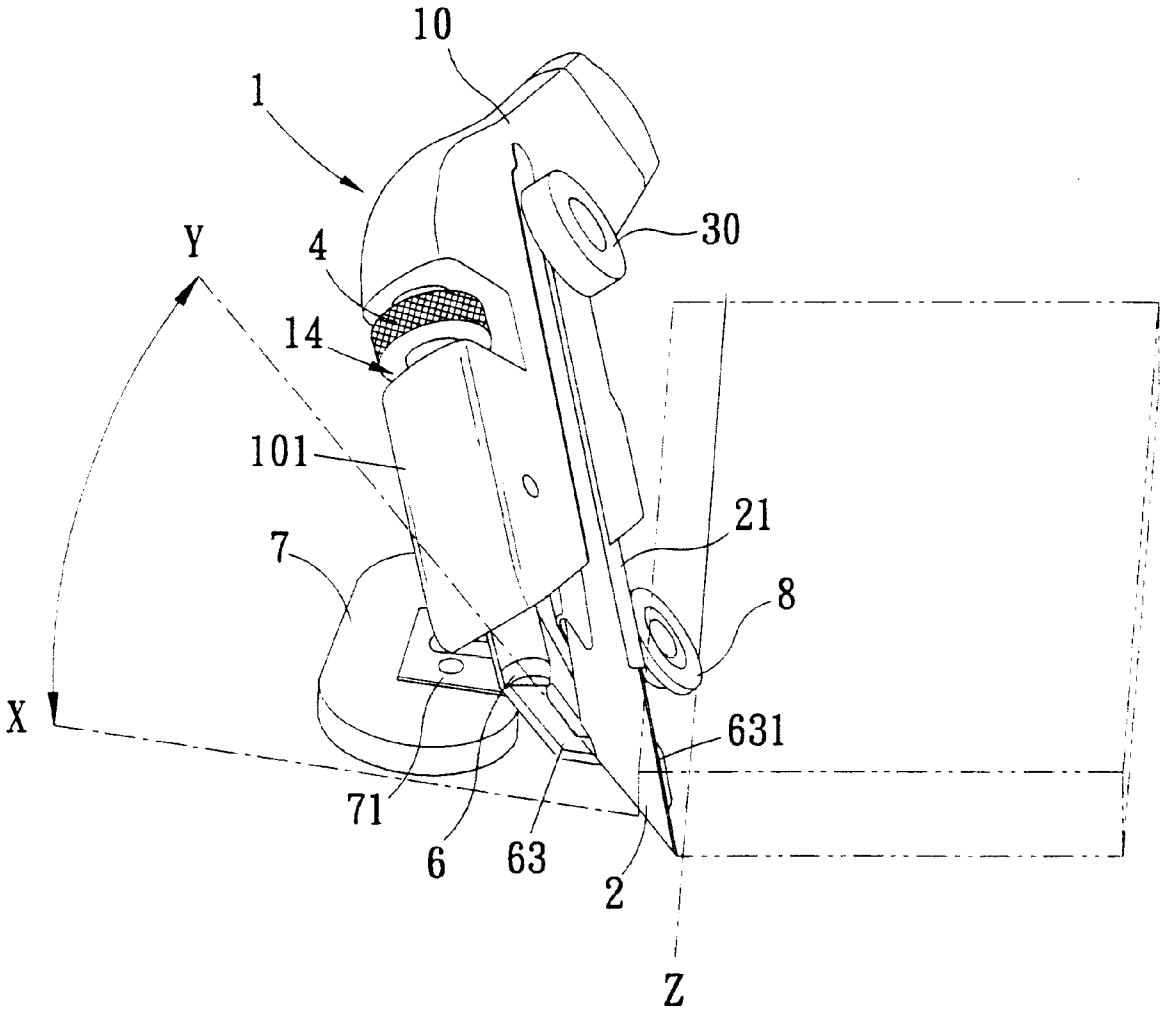
FIG. 4 is a slanted prospective movement view of the present invention.

Now, on the posterior of knife part 101 and adjacent to indentation 11 is lock groove 160 to which the U shaped arm 71 connected to slant panel 7 is fixed to lock groove 160 by means of screw 72 passing through opening 711 in connecting arm 71, thereby providing the present invention the angle needed for precisely cutting To understand the situation just described above please refer to FIG. 4 which shows how when using the present invention for angle cutting slant panel 7 is able to smoothly attach to the supporting surface and curve to the proper angle by the support of wheel 8 and cutting edge 21. The meeting point of axis Y, where blade 2 extends out, and axis X, on the plane of slant panel 7, is the cutting angle. Also, axis Z formed by connecting the rolling point of wheel 8 and the tip of cutting edge 21 on blade 2 is the cutting direction. The present invention thus possesses the functions of cutting at angles and cutting in a straight line without a ruler.

Figures 1, 5:
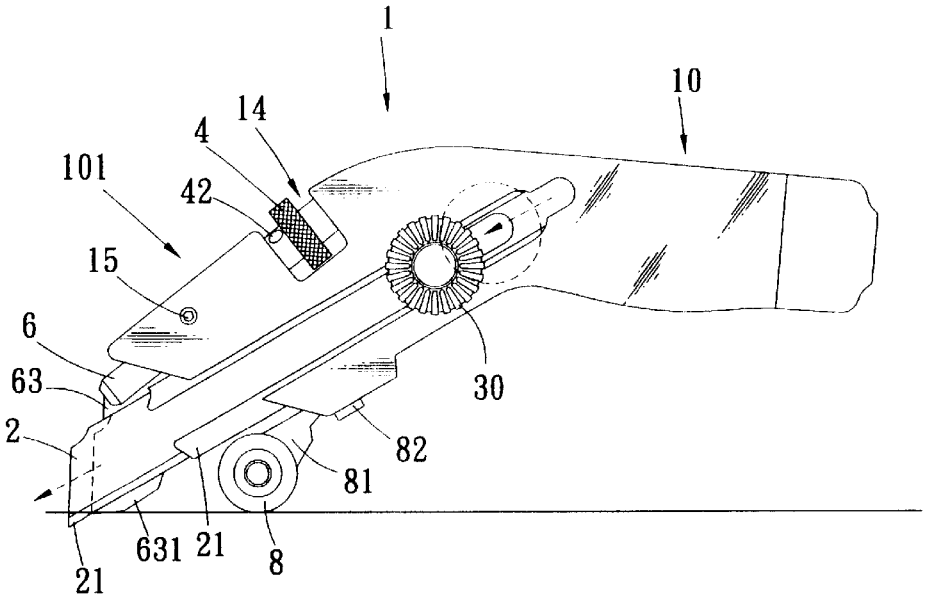
Figures 2, 5:
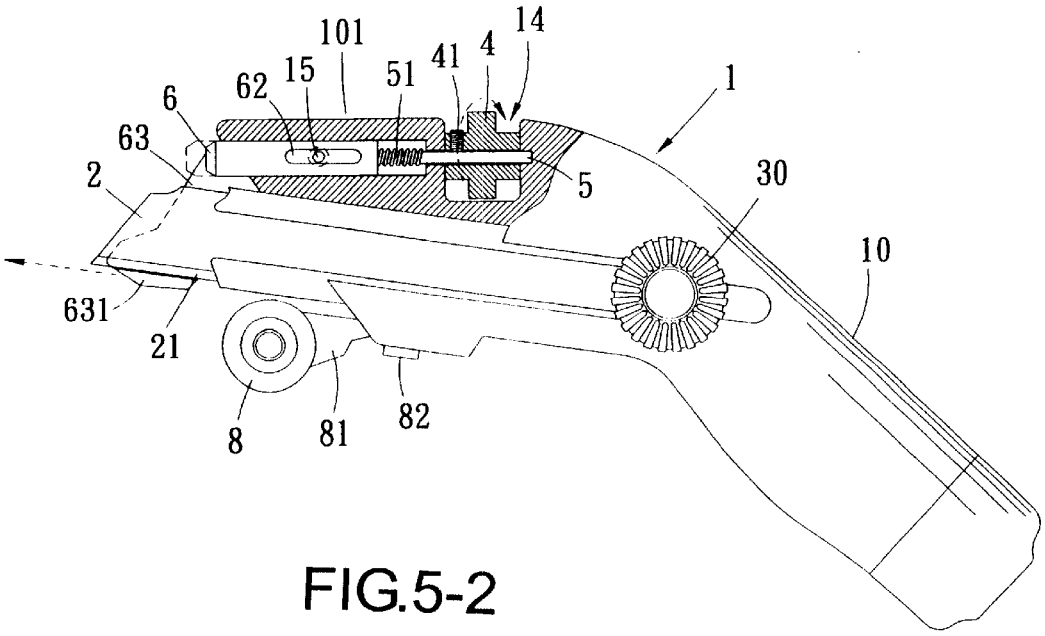

Now please refer to FIG. 5—1 and FIG. 5—2 to see how when using the present invention the user must move handle part 10 up for wheel 8 to provide a support point and cause blade 2 to move in the direction of the surface to be cut. Also, if greater depth adjustment is required holding bolt 30 can be directly adjusted to extend blade 2 out. In the same way if cutting edge 21 of blade 2 needs to be adjusted to a shallow depth adjustable wheel 4 can be turned causing shaft 5 to control the movement of adjustable bolt 6 either forward or backward and thereby allow prop 631 of support piece 63 to be adjusted to within very small distances from the tip of blade 2 further allowing the present invention to increase the life cycle of blade 2 by reducing the pressure put on blade 2 during cutting.

Overall, the structure of the present exacter knife invention allows users to conserve energy while cutting and increases exacter knife usefulness by allowing angled cutting; the wheel structure assists cutting to allow the present invention to avoid damage while cutting in a straight line without needing a ruler edge; the adjustable bolt allows control of knife cutting depth while keeping the blade life from being influenced by excessive force and increasing user safety. While the form of apparatus herein described constitutes a preferred embodiment of this invention, it is to be understood that the invention is not limited to this precise form of apparatus, and that changes may be made therein without departing from the scope of the invention which is defined in the appended claims.

I claim:

1. A multi-functional exacting knife assembly comprising:

a) a knife body including a knife part and a handle part, the handle part extending at an obtuse angle from the knife part, a top of the knife part having an upwardly opening trough therein, a tube trough in the knife part opening through an end of the knife part;

b) a trough case mounted in the knife part and extending outwardly from the end of the knife part;

c) a cutting blade movably located in the trough case;

d) a blade holding structure including a base slidably located in the trough case and connected to the cutting blade, a holding bolt attached to the base and extending exteriorly of the knife body, whereby movement of the holding bolt relative to the knife body moves the cutting blade relative to the trough case;

e) a guide wheel attached to a bottom of the knife part;

f) an adjusting wheel rotatably connected to the knife part and located in the upwardly opening trough; and, g) an adjustable blade guide support including a guiding support with a prop to adjust a depth of cut of a cutting edge of the cutting blade, an adjusting bolt extending from the guiding support and axially slidably mounted in the tube trough of the knife part, the adjusting bolt connected to the adjusting wheel whereby rotation of the adjusting wheel moves the adjusting bolt and the guiding support relative to the knife body.

2. The multi-functional exacting knife assembly of claim 1 further comprising a shaft connected to the adjusting wheel so as to rotate therewith, an end of the shaft threadingly engaged with the adjusting bolt.

3. The multi-functional exacting knife assembly of claim 2 further comprising an elongated slot in the adjusting bolt and a fixing bolt attached to the knife part and engaging the elongated slot.

4. The multi-functional exacting knife assembly of claim 1, further comprising a cutting angle guide including a slant panel with a U-shaped arm extending therefrom.

* * * * *